US007556017B2

(12) United States Patent
Gibson

(10) Patent No.: US 7,556,017 B2
(45) Date of Patent: Jul. 7, 2009

(54) TWIN NEEDLE VALVE DUAL MODE INJECTOR

(75) Inventor: Dennis Henderson Gibson, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 483 days.

(21) Appl. No.: 11/393,706

(22) Filed: Mar. 31, 2006

(65) Prior Publication Data

US 2007/0246561 A1 Oct. 25, 2007

(51) Int. Cl.
*F02M 47/02* (2006.01)

(52) U.S. Cl. ..... 123/299; 123/305; 239/585.5

(58) Field of Classification Search ..... 123/299, 123/305; 239/585.5
See application file for complete search history.

(56) References Cited

U.S. PATENT DOCUMENTS

| | | | | |
|---|---|---|---|---|
| 2,002,134 | A * | 5/1935 | Baj | 239/533.5 |
| 3,764,076 | A * | 10/1973 | Eblen | 239/533.6 |
| 4,356,976 | A * | 11/1982 | Eblen et al. | 239/533.5 |
| 4,499,862 | A | 2/1985 | Bäumer et al. | |
| 4,700,672 | A | 10/1987 | Baguena | |
| 4,856,713 | A | 8/1989 | Burnett | |
| 5,072,706 | A | 12/1991 | Eblen et al. | |
| 5,365,902 | A | 11/1994 | Hsu | |
| 5,647,316 | A | 7/1997 | Hellén et al. | |
| 5,758,618 | A | 6/1998 | Jay et al. | |
| 5,862,793 | A | 1/1999 | Jay et al. | |
| 5,875,743 | A | 3/1999 | Dickey | |
| 6,073,862 | A * | 6/2000 | Touchette et al. | 239/408 |
| 6,422,199 | B1 | 7/2002 | Buckley et al. | |
| 6,439,193 | B2 | 8/2002 | Lehtonen | |
| 6,725,838 | B2 | 4/2004 | Shafer et al. | |
| 6,769,635 | B2 | 8/2004 | Stewart et al. | |
| 6,843,434 | B2 | 1/2005 | Lawrence et al. | |
| 6,886,762 | B2 | 5/2005 | Angelino et al. | |
| 6,889,918 | B2 * | 5/2005 | Harcombe | 239/533.2 |
| 6,945,475 | B2 | 9/2005 | Lawrence et al. | |
| 6,973,921 | B2 | 12/2005 | Shafer et al. | |
| 6,978,760 | B2 | 12/2005 | Stewart et al. | |
| 2004/0021013 | A1 | 2/2004 | Lawrence | |
| 2005/0224605 | A1 | 10/2005 | Dingle | |

FOREIGN PATENT DOCUMENTS

| | | |
|---|---|---|
| JP | 2004-183647 | 7/2004 |

* cited by examiner

*Primary Examiner*—Erick Solis
(74) *Attorney, Agent, or Firm*—Finnegan, Henderson, Farabow, Garrett & Dunner

(57) ABSTRACT

A fuel injector having an injector body defining a hollow interior configured to receive pressurized fuel, a first nozzle configured for providing a first fuel spray pattern, and a second nozzle configured for providing a second fuel spray pattern different from the first fuel spray pattern. The first and second nozzles may be configured to inject fuel supplied from a common source into a combustion space. The fuel injector may further include first and second needle valve members corresponding to the first and second nozzles, respectively. The first and second needle valve members may be positioned within the hollow interior of the injector body, with the second needle valve member being spaced from, but adjacent to the first needle valve member.

20 Claims, 5 Drawing Sheets

TWIN NEEDLE VALVE DUAL MODE INJECTOR

TECHNICAL FIELD

The present disclosure relates generally to dual mode fuel injection systems and, more particularly, to a fuel injector with the ability to produce two different spray patterns via independently controlled, adjacent needle valve members.

BACKGROUND

Over the years, engineers have been challenged to devise a number of different solutions toward the goal of a cleaner burning engine, such as, for example, a diesel engine. Experience has taught that various injection timings, quantities, and rates have a variety of different desirable results over the complete operating range of a given engine. Therefore, fuel injection systems with a variety of different capabilities can generally out-perform fuel injection systems with narrower capability ranges, at least in their ability to reduce undesirable emissions. For instance, the leap from cam control to electronic control in fuel injection systems has permitted substantially lower emissions in several categories, including but not limited to $NO_x$, hydrocarbons, and smoke.

One area that appears to show promise in reducing undesirable emissions is often referred to as homogeneous charge compression ignition (HCCI). In an HCCI engine, fuel is injected early in the compression stroke to permit thorough mixing with cylinder air, to ideally form a lean homogeneously mixed charge before conditions in the cylinder cause auto-ignition. Engines operating in an HCCI mode have shown relatively low outputs of undesirable emissions. Although an HCCI strategy appears promising, it is not without drawbacks. For instance, HCCI can cause extremely high cylinder pressure rise rates and force loads, rendering it most desirable at the lower half of the engine's operating range. Also, it may be difficult to control ignition timing in engines operating with an HCCI strategy. Thus, at this time, a pure HCCI strategy is not viable for most commercial engine applications with conventional power density requirements.

This limitation of HCCI has been addressed in the art by equipping an engine with an HCCI fuel injection system and a conventional fuel injection system. For instance, such a dual system is shown in U.S. Pat. No. 5,875,743 to Dickey. Although such a dual system appears viable, the high expense and complexity brought by two complete injection systems renders it commercially challenged. A single fuel injector is generally not compatible with performing both HCCI and conventional injections because different spray patterns are often desirable and sometimes necessitated. Providing a structure in a single fuel injector that is capable of injecting fuel in two different spray patterns, while maintaining the ability to mass produce the fuel injector and retain consistent results, has been problematic and elusive.

The present disclosure is directed to overcoming one or more of the shortcomings set forth above.

SUMMARY OF THE INVENTION

In one aspect, the present disclosure is directed to a fuel injector having an injector body defining a hollow interior configured to receive pressurized fuel, a first nozzle configured for providing a first fuel spray pattern, and a second nozzle configured for providing a second fuel spray pattern different from the first fuel spray pattern. The first and second nozzles may be configured to inject fuel supplied from a common source into a combustion space. The fuel injector may further include first and second needle valve members corresponding to the first and second nozzles, respectively. The first and second needle valve members may be positioned within the hollow interior of the injector body, with the second needle valve member being spaced from, but adjacent to the first needle valve member.

In another aspect, the present disclosure is directed to a fuel injection system having a common fuel rail containing pressurized fuel, at least one control valve fluidly connected to the common fuel rail, and at least one fuel injector fluidly connected to said common fuel rail. The fuel injector includes an injector body having a first nozzle and a second nozzle, with the first nozzle being configured to produce a first fuel injection spray pattern and the second nozzle being configured to produce a second fuel injection spray pattern different from the first fuel injection spray pattern. Furthermore, each fuel injector may include a first needle valve member and a second needle valve member, the second valve needle member being spaced from, but adjacent to the first needle valve member.

In yet another aspect, the present disclosure is directed to a method of injecting fuel. The method includes injecting fuel through a first nozzle at least in part by moving a first needle valve member by reducing fuel pressure in a first control chamber within an injector body while maintaining fuel pressure in the remainder of the injector body. The method also includes injecting fuel through a second nozzle at least in part by moving a second needle valve member by reducing fuel pressure in a second control chamber within the injector body while maintaining fuel pressure in the remainder of the injector body. The second needle valve member being spaced from, but adjacent to the first needle valve member.

DETAILED DESCRIPTION

Figure 1:
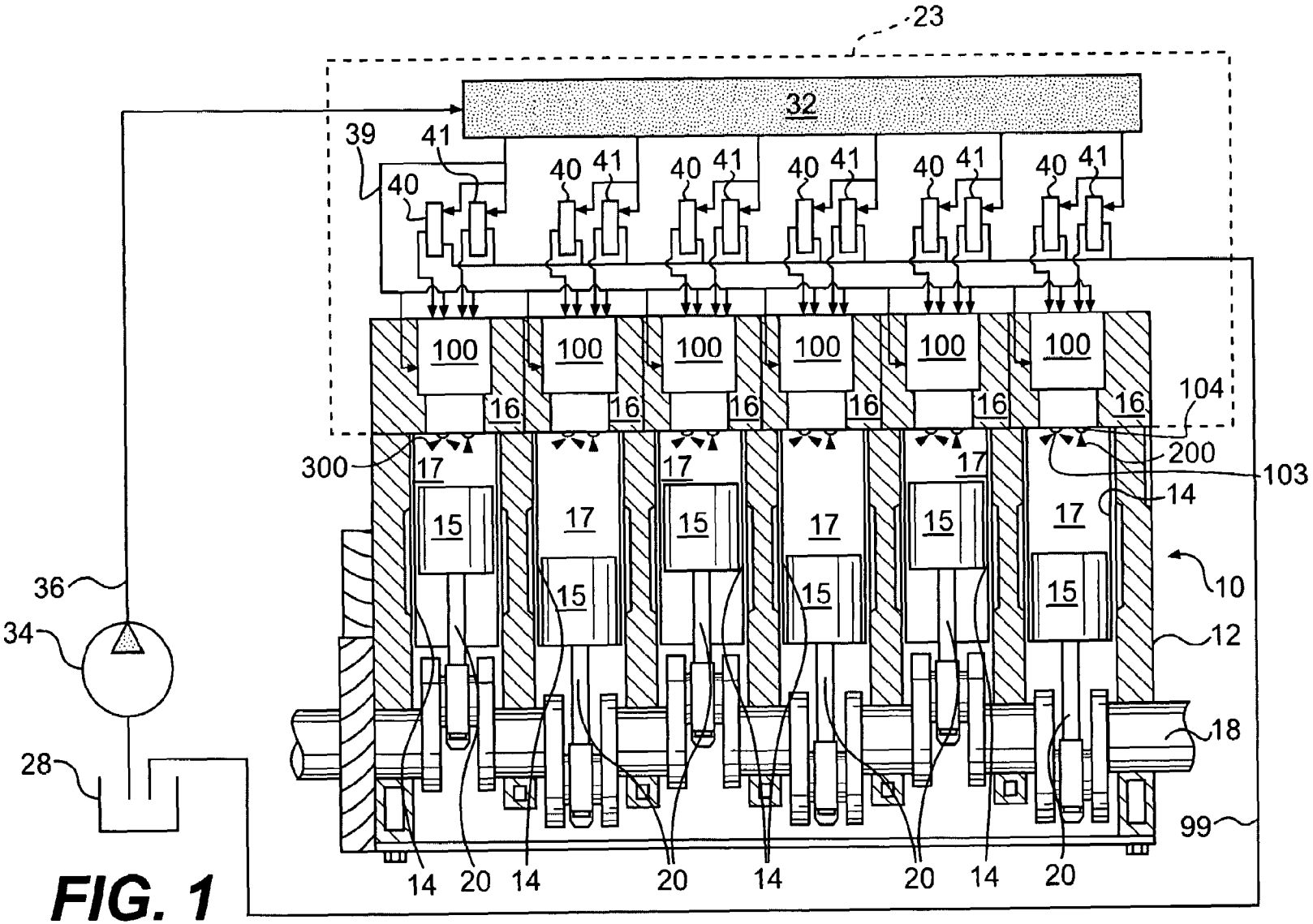
FIG. 1 is a schematic and diagrammatic illustration of an exemplary embodiment of an internal combustion engine having a fuel injection system in accordance with the present disclosure.

Referring to FIG. 1, there is illustrated an embodiment of a fuel injection system 23 in accordance with the present disclosure. For discussion purposes only, fuel injection system 23 is described in connection with an exemplary engine 10. For the purposes of this disclosure, engine 10 is depicted and described as a four-stroke diesel engine. One skilled in the art will recognize, however, that engine 10 may be any other type of internal combustion engine, such as, for example, a gasoline or gaseous fuel driven engine.

In the illustrated embodiment, engine 10 includes an engine block 12 that defines a plurality of cylinders 14, each having a reciprocating piston 15 slidably disposed therein. Furthermore, engine 10 may include a cylinder head 16 associated with each cylinder 14. Cylinder 14, piston 15, and cylinder head 16 cooperate together to form a combustion chamber 17. Although the exemplary engine 10 is depicted as including six combustion chambers 17, one skilled in the art will readily recognize that engine 10 may include a greater or lesser number of combustion chambers 17, and that combustion chambers 17 may be disposed in an "in-line" configuration, a "V" configuration, or any other suitable configuration known in the art. Engine 10 may also include a crankshaft 18 that is rotatably disposed within engine block 12. A connecting rod 20 may connect each piston 15 to crankshaft 18, so that a sliding motion of piston 15 within the respective cylinder 14 results in a rotation of crankshaft 18.

Figure 2:
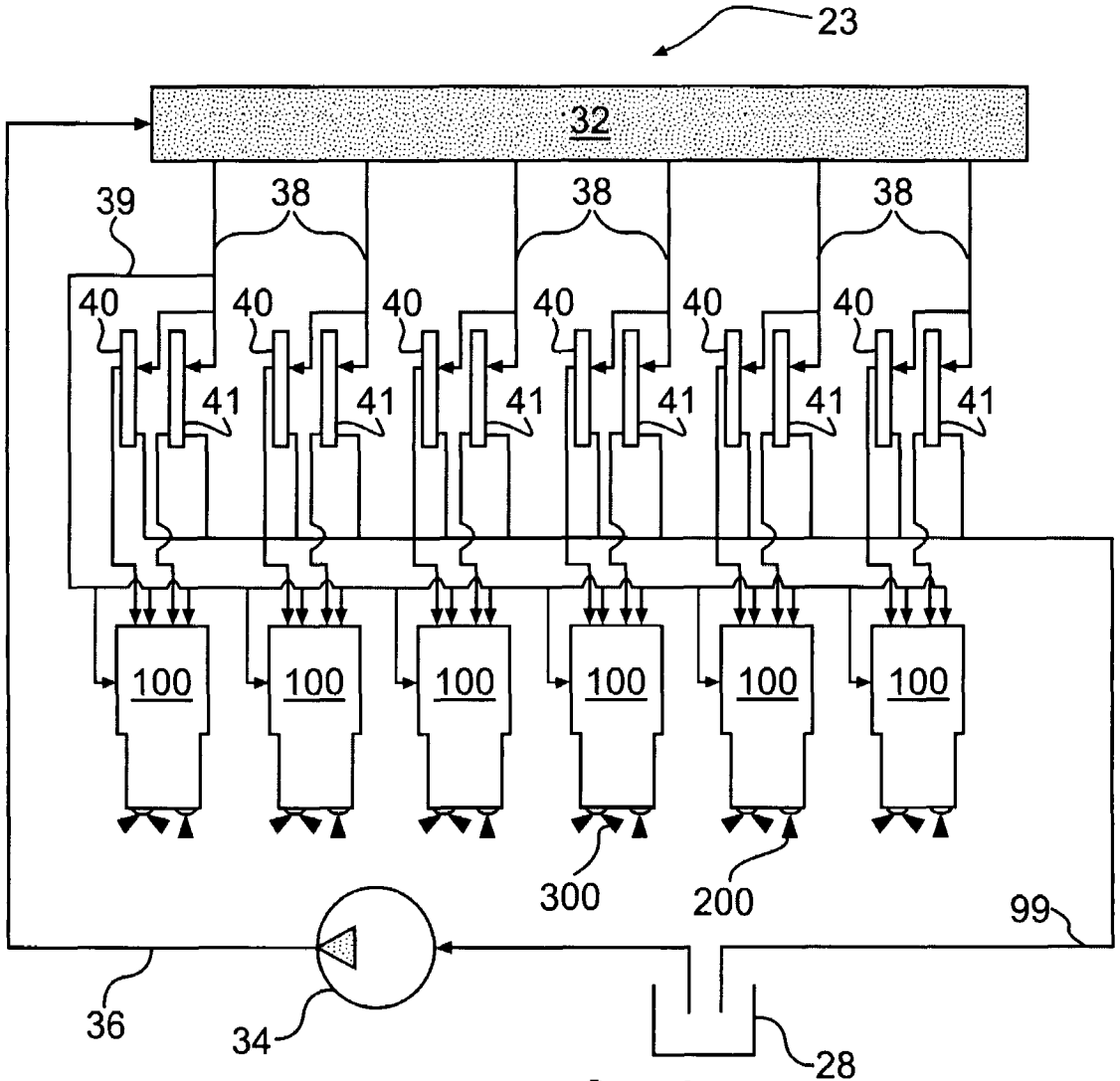
FIG. 2 is a schematic and diagrammatic illustration of an exemplary embodiment of a fuel injection system in accordance with the present disclosure.

With reference to FIGS. 1 and 2, fuel injection system 23 may include a common fuel rail 32, a plurality of first control valves 40, a plurality of second control valves 41, and a plurality of fuel injectors 100. Each fuel injector 100 may be positioned such that a portion (e.g., nozzles 103, 104) of the fuel injector 100 is at least partially positioned in an associated combustion chamber 17. Furthermore, each fuel injector 100 may be operable to inject an amount of pressurized fuel into an associated combustion chamber 17 at predetermined fuel pressures and fuel flow rates.

The timing of fuel injection into combustion chamber 17 may be synchronized with the motion of piston 15. For example, fuel may be injected as the piston 15 nears a top-dead-center position in a compression stroke to allow for conventional compression-ignited-combustion of the injected fuel. Alternatively, fuel may be injected as the piston 15 begins the compression stroke heading towards a top-dead-center position for an HCCI operation.

Returning to fuel injection system 23, each fuel injector 100 may be fluidly connected to common fuel rail 32 via a first control valve 40 and a second control valve 41. As will be discussed below, common fuel rail 32 may also be directly connected to each fuel injector 100 at one or more locations by a second fuel line 39, in order to facilitate operation of the fuel injectors 100. Pressurized fuel may be supplied to common fuel rail 32 by any suitable means known in the art. For example, pressurized fuel may be provided to common fuel rail 32 through a main fuel line 36 by a fuel transfer pump (not shown) and a high-pressure pump 34, which are adapted to draw fuel from a fuel source 28 such as, for example, a convention fuel tank containing distillate diesel fuel. High-pressure fuel pump 34 is preferably an engine driven pump that has a capacity to supply high pressure fuel to common fuel rail 32 to meet the maximum projected needs of the fuel injection system 23. Unused pumped fuel may be returned to fuel source 28 through a low pressure drain passage 99 in any conventional manner.

Figure 3:
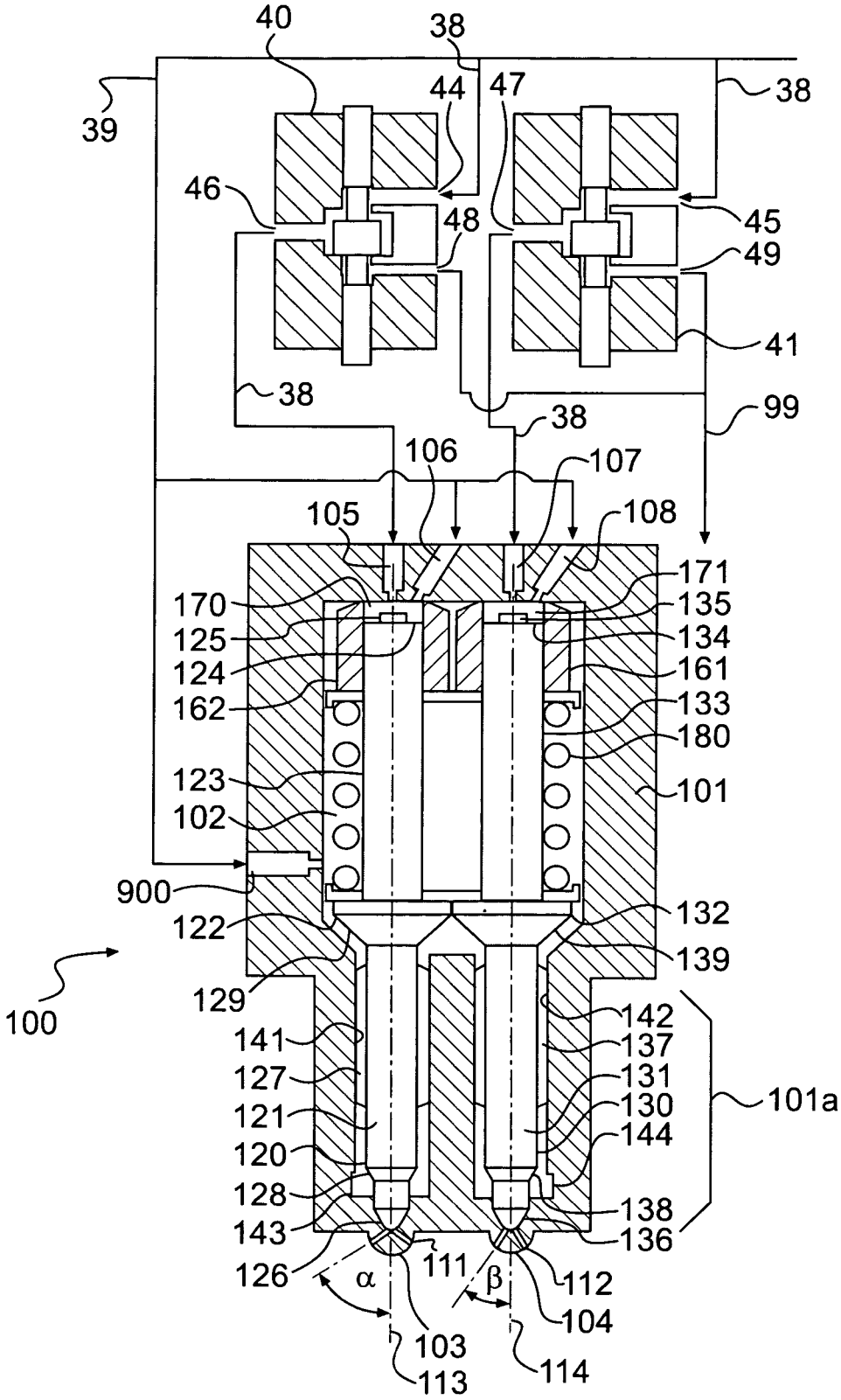
FIG. 3 is a schematic illustration of a dual mode, twin needle fuel injector of the fuel injection system of FIG. 2.

With reference to FIG. 3, each of first and second control valves 40, 41 may include an inlet 44, 45, respectively, fluidly connected to common fuel rail 32 by a fuel line 38. Each of first and second control valves 40, 41 may also include an outlet 46, 47, respectively, fluidly connected to fuel injector 100 by additional fuel lines 38. In addition, each of first and second control valves 40, 41, may include a drain outlet 48, 49, respectively, in fluid communication with drain passage 99, to return unused fuel to fuel source 28.

First and second control valves 40, 41 may be configured to move between a first, de-activated position and a second, actuated position. In the first, de-activated position, valves 40, 41 may be configured to channel fuel entering inlets 44, 45 to outlets 46, 47, respectively. In the second, actuated position, valves 40, 41 may be configured to prevent the entry of fuel into valves 40, 41 by closing inlets 44, 45, respectively, while at the same time fluidly connecting outlets 46, 47 to drain outlets 48, 49, respectively. Those of ordinary skill in the art will appreciate that first and second control valves 40, 41 may be operated and controlled by any suitable means known in the art. For example, control valves 40, 41 may be actuated by a solenoid or piezo that responds to control signals provided by known sensors (not shown) commonly disposed in engine 10.

First and second control valves 40, 41 may include any suitable valve known in the art. Although it is contemplated that first and second control valves 40, 41 may be substantially identical in structure to one another, it will be readily apparent to those skilled in the art that first control valve 40 may differ from second control valve 41 in any of a number ways. Moreover, although the illustrated embodiments depict that first and second control valves 40, 41 may be housed separately, it will be readily apparent to those skilled in the art that first and second control valves 40, 41 may be disposed within the same housing. In addition, rather than being housed and disposed independently of fuel injector 100, those of ordinary skill will also appreciate that first and second control valves 40, 41 may be disposed within injector body 101 of fuel injector 100. Moreover, it is contemplated that first and second control valves 40, 41 may be replaced by a single master control valve (not shown) capable of performing the functions of both first and second control valves 40, 41.

As will be readily appreciated by those skilled in the art, aspects of this disclosure relating to fuel circulation, fuel pressurization, and/or fuel control can take on a wide variety of structures and configurations without departing from the scope of the present disclosure.

With continuing reference to FIG. 3, each fuel injector 100 may include an injector body 101 that defines a hollow interior 102. Injector body 101 may have any desired shape and/or configuration, such as, for example, a substantially cylindrical shape. Additionally, body 101 may have any desired cross-sectional configuration, such as, for example, a substantially circular cross-sectional shape. In addition, body 101 may have one or more cross-sectional shapes along its length. For example, body 101 may have a lower nozzle portion 111*a* that is relatively narrower than the remainder of body 101. Furthermore, body 101 may be made of any suitable materials known in the art, such as, for example, steel. Body 101 may also be fabricated by any known manufacturing processes in the art, such as, for example, machining and/or casting.

Injector body 101 may further include a first nozzle 103, a second nozzle 104, a first valve inlet 105 in fluid communication with first control valve 40, a first rail inlet 106 to fluidly connect common fuel rail 32 to interior 102, a second valve inlet 107 in fluid communication with second control valve 41, a second rail inlet 108 to fluidly connect common fuel rail 32 to interior 102, and a fuel inlet 900 in direct fluid communication with common fuel rail 32. First valve inlet 105, first rail inlet 106, second valve inlet 107, and second rail inlet 108 may be identical to or substantially different from one another in any of a number ways. For example, first and second valve inlets 105, 107 may include an identical size, but may be slightly larger than first and second rail inlets 106, 108. Additionally, fuel inlet 900 may have any suitable size and shape capable of allowing sufficient fuel to enter interior 102 from common fuel rail 32, such that the fuel in interior 102 is maintained at the high pressure of common fuel rail 32 at all times, even during the below-noted injection events. Those of ordinary skill in the art will appreciate that the sizes and shapes of first valve inlet 105, first rail inlet 106, second valve inlet 107, second rail inlet 108, and fuel inlet 900 may be varied without departing from the scope and spirit of the present disclosure.

First nozzle 103 may include one or more first nozzle openings 111 that are oriented at a first angle $\alpha$ with respect to a centerline 113 of first nozzle 103. Second nozzle 104 may include one or more second nozzle openings 112 that are oriented at a second angle β with respect to a centerline 114 of second nozzle 104. Those skilled in the art will readily recognize that the angle of orientation αmay be either identical to or substantially different from the angle of orientation β. For example, first nozzle openings 111 may be oriented at a relatively large angle α, and second nozzle openings 112 may be oriented at a relatively small angle β, such that first nozzle openings 111 are adapted to inject fuel in a manner consistent with a conventional fuel injection event and second nozzle openings 112 are adapted to inject fuel in a manner consistent with an HCCI fuel injection event. Those skilled in the art will appreciate that homogeneous charge fuel injection nozzle openings, unlike conventional fuel injection nozzle openings, are oriented in a way to facilitate mixing of fuel and air while the engine piston is undergoing its compression stroke.

Figure 4:
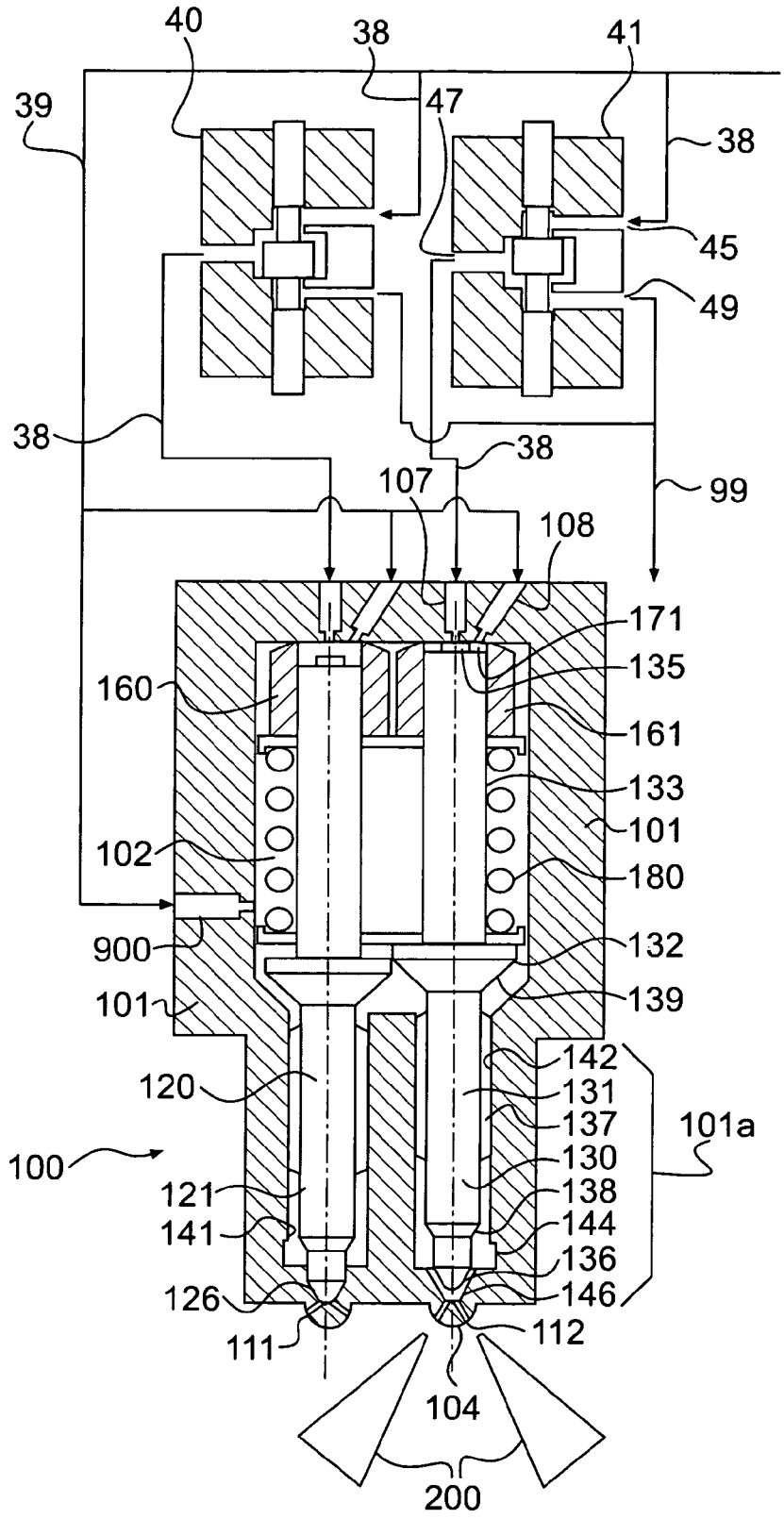
FIG. 4 is a schematic illustration of the fuel injector of FIG. 3 in an HCCI injection mode.
Figure 5:
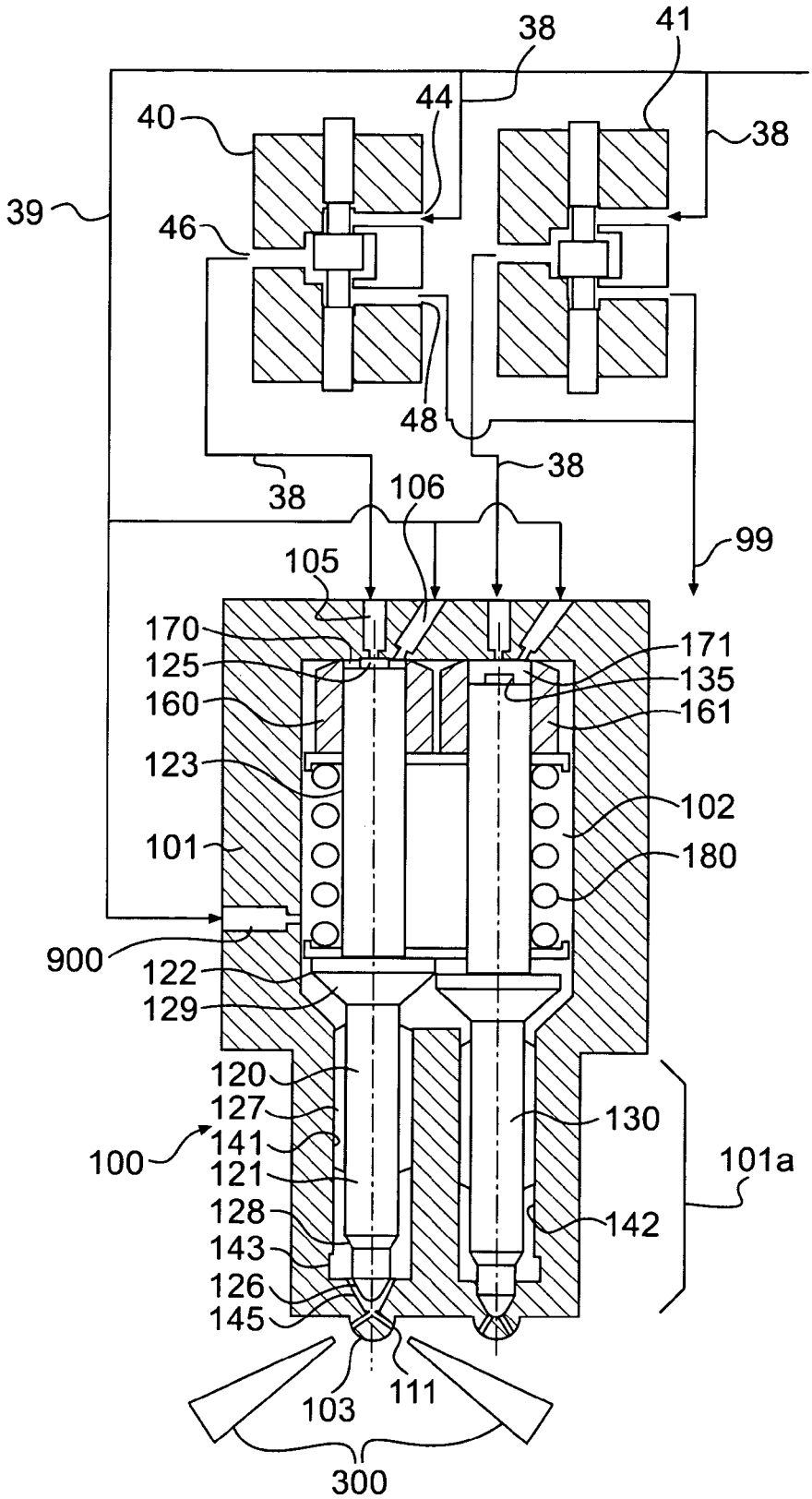
FIG. 5 is a schematic illustration of the fuel injector of FIG. 3 in a conventional injection mode.

As shown in FIGS. 3-5, the interior 102 of body 101 may be provided with first and second bores 141, 142 arranged in parallel and which extend through lower nozzle portion 101*a*. Bores 141, 142 may include intermediate regions 143, 144, respectively, of enlarged diameters, and blind end regions defining first and second seating surfaces 145, 146, respectively, of frusto conical form. First and second seating surfaces 145, 146 may serve to fluidly connect bores 141, 142, respectively, with first and second nozzle openings 111, 112, respectively.

At the end of interior 102 opposite from first and second bores 141, 142, interior 102 may be provided with first and second needle guides 160, 161. Needle guides 160, 161 may be adapted to receive first and second needle valve members 120, 130, respectively. Needle guides 160, 161 may be of any suitable shape and form necessary to permit reciprocal, sliding movement of first and second needle valve members 120, 130. Furthermore, needle guides 160, 161 may be fabricated by any known suitable manufacturing process, such as, for example, machining. Needle guides 160, 161 may also be made from any known suitable materials, such as, for example, steel. In some embodiments, rather than providing needle guides 160, 161 to the interior 102 of body 101 during assembly of injector 100, needle guides 160, 161 may be created as features of body 101 during the manufacturing of body 101.

First and second needle valve members 120, 130 may be arranged side-by-side within interior 102. Additionally, first and second needle valve members 120, 130 may be slidably movable within interior 102 between an upward open position and a downward closed position, and may be biased toward the closed positions by a suitable biasing spring 180. Although the illustrated embodiments depict that a single spring 180 may be sufficient to bias both first and second needle valve members 120, 130 toward their closed positions, those of ordinary skill in the art will readily recognize that biasing spring 180 may be replaced by two or more biasing springs (not shown) capable of separately urging first and second needle valve members 120, 130 toward their closed positions. Furthermore, although the illustrated embodiments depict that first and second needle valve members 120, 130 and their respective nozzles 103, 104 are disposed at substantially the same height above the associated combustion chamber 17, those of ordinary skill in the art will appreciate that the height of either of the first and second needle valve members 120, 130, along with their respective nozzles 103, 104, above the combustion chamber 17 may be varied with respect to the other of the first and second needle valve members 120, 130 and its respective nozzle. For example, first needle valve member 120 and nozzle 103 may be disposed slightly higher or lower than second needle valve member 130 and nozzle 104.

First needle valve member 120 may include a lower portion 121, an intermediate portion 122, and an upper portion 123. First needle valve member 120 may include any suitable size and shape known in the art. For example, first needle valve member 120 may include a substantially cylindrical shape. Additionally, first needle valve member 120 may also include one or more cross-sectional shapes along its length. For example, upper portion 123 may have a larger diameter than lower portion 121, and intermediate portion 122 may have a larger diameter than both lower portion 121 and upper portion 123.

Referring to FIGS. 3 and 5, lower portion 121 of first needle valve member 120 may be configured to be slidably received within first bore 141, and may be provided with a first tip portion 126 that is engageable with first seating surface 145 to control fuel flow through first nozzle openings 111. Lower portion 121 may also be provided with a plurality of first protrusions 127 extending radially outward from the periphery of lower portion 121. First protrusions 127 may be of any suitable size and shape, and may be configured to facilitate the sliding of lower portion 121 within bore 141. Furthermore, lower portion 121 may be provided with a first lower hydraulic surface 128 that is exposed to the fuel pressure within intermediate region 143 of bore 141.

Intermediate portion 122 may extend upwards from lower portion 121. As discussed above, intermediate portion 122 may include a diameter larger than that of lower portion 121. Intermediate portion 122 may be provided with a first upper hydraulic surface 129 that is also exposed to the fuel pressure within interior 102.

Upper portion 123 may extend upwards from intermediate portion 122. As discussed above, upper portion 123 may have a diameter smaller than that of intermediate portion 122, but larger than the diameter of lower portion 121. Upper 123 may be provided with a top surface 124. Top surface 124 may have an upwardly extending projection 125 disposed thereon. As shown in FIG. 5, projection 125 may serve as a stop that defines the travel distance of first needle valve member 120 between the open and closed positions.

Top surface 124, together with needle guide 160, may also define a first control chamber 170. Control chamber 170 may be fluidly connected to first valve inlet 105 and first rail inlet 106. Control chamber 170, however, may be fluidly separated from the remainder of interior 102 by needle guide 160. Furthermore, control chamber 170 may have any suitable size and shape known in the art, such that when control chamber 170 is filled with pressurized fuel, the force of the pressurized fuel acting on top surface 124, together with biasing spring 180, is sufficient to urge first needle valve member 120 towards its closed position.

Like first needle valve member 120, second needle valve member 130 may include a lower portion 131, an intermediate portion 132, and an upper portion 133. Second needle valve member 130 may include any suitable size and shape known in the art. For example, second needle valve member 130 may include a substantially cylindrical shape. Second needle valve member 130 may also include one or more cross-sectional shapes along its length. For example, upper portion 133 may have a large diameter than lower portion 131, and intermediate portion 132 may have a large diameter than both lower portion 131 and upper portion 133.

Referring to FIGS. 3 and 4, lower portion 131 of second needle valve member 130 may be configured to be slidably received within second bore 142, and may be provided with a second tip portion 136 that is engageable with second seating surface 146 to control fuel flow through second nozzle openings 112. Lower portion 131 may also be provided with a plurality of second protrusions 137 extending radially outward from the periphery of lower portion 131. Second protrusions 137 may be of any suitable size and shape, and may be configured to facilitate the sliding of lower portion 131 within bore 142. Furthermore, lower portion 131 may be provided with a second lower hydraulic surface 138 that is exposed to the fuel pressure within intermediate region 144 of bore 142.

Intermediate portion 132 may extend upwards from lower portion 131. As discussed above, intermediate portion 132 may include a diameter larger than that of lower portion 131. Intermediate portion 132 may be provided with a second upper hydraulic surface 139 that is exposed to the fuel pressure within interior 102.

Upper portion 133 may extend upwards from intermediate portion 132. As discussed above, upper portion 133 may have a diameter smaller than that of intermediate portion 132, but larger than the diameter of lower portion 131. Upper portion 133 may be provided with a top surface 134. Top surface 134 may have an upwardly extending projection 135 disposed thereon. As shown in FIG. 4, projection 135 may serve as a stop that defines the travel distance of second needle valve member 130 between the open and closed positions.

Top surface 134, together with needle guide 161, may also define a second control chamber 171. Second control chamber 171 may be fluidly connected to second valve inlet 107 and second rail inlet 108. Second control chamber 171, however, may be fluidly separated from the remainder of interior 102 by needle guide 161. Furthermore, second control chamber 171 may have any suitable size and shape known in the art, such that when second control chamber 171 is full with pressurized fuel, the force of the pressurized fuel acting on top surface 134, together with biasing spring 180, is sufficient to urge second needle valve member 130 to the closed position.

INDUSTRIAL APPLICABILITY

The fuel injection system 23 and fuel injectors 100 of the present disclosure are generally applicable to any internal combustion engine. However, the present disclosure finds particular applicability in relation to compression ignition engines in which the injector nozzles are at least partially positioned in the engine cylinder for direct injection into the combustion space. Nevertheless, those skilled in the art will appreciate that the present disclosure could find potential application in other engines, including but not limited to spark ignition engines.

The present disclosure finds particular applicability to compression ignition engines because of its ability to advantageously produce two different spray patterns depending on how the engine is operated. For instance, under relatively low load conditions, it might be desirable to operate the engine in a pure homogeneous charge mode in which fuel is injected relatively early in the compression stroke when the piston is closer to a bottom-dead-center position than a top-dead-center position. Alternatively, in some instances, it may be desirable to inject fuel at the end of the intake stroke of the piston. As the piston continues moving upward, the fuel charge preferably thoroughly mixes with air in the cylinder to produce a relatively lean homogeneous mixture that spontaneously combusts when the engine piston nears its top-dead-center position.

When the engine is being operated at relatively high speeds and loads, it might be desirable to operate the fuel injection system in a conventional mode in which fuel is sprayed into the engine cylinder in a conventional spray pattern when the engine piston is at or near its top-dead-center position. In between these two extremes, it might be desirable to operate the fuel injection system in a mixed mode in which some fuel is injected through the HCCI configured nozzle early in the engine cycle and then later in the engine cycle additional fuel is injected via the nozzle configured for conventional injection when the engine piston is at or near its top-dead-center position. Since each of the needle valve members 120, 130 may be independently controlled, fuel may also be sprayed through both nozzles simultaneously, if desired.

Testing has shown that having the ability to produce the above-mentioned spray patterns at any desirable timing in the engine cycle can allow for an overall reduction in undesirable emissions, including NOx, unburned hydrocarbons, and particulates. Thus, the fuel injection system of the present disclosure allows for different spray patterns (e.g., HCCI and conventional spray patterns) that can be produced independently or simultaneously, at any desired timing, independent of engine speed or crank angle, and at a wide range of injection pressures that can be obtained through control of fuel pressure in the common fuel rail.

The operation of fuel injection system 23 and, in particular, fuel injector 100 will be explained below. The following explanation is provided for exemplary purposes only. Those skilled in the art will appreciate that a wide variety of variations could be made to the illustrated embodiments and the following exemplary description without departing from the intended scope of the disclosure.

Referring to FIGS. 3-5, pressurized fuel may be provided from fuel source 28 to common fuel rail 32 by a fuel transfer pump and a high-pressure fuel pump 34, such that the fuel stored in common fuel rail 32 is constantly under high pressure. Prior to an injection event, first and second control valves 40, 41 are in a de-activated position such that high pressure fuel entering the valves 40, 41 from the common fuel rail 32 at inlets 44, 45, respectively, is directly channeled to the first and second control chambers 170, 171 and the interior 102 of injector body 101 through first and second valve inlets 105, 107. Additionally, since common fuel rail 102 is in direct fluid communication with first and second rail inlets 106, 108, first and second control chambers 170, 171 are also provided with pressurized fuel from common fuel rail 32. Moreover, since common fuel rail 32 is also in direct fluid communication with fuel inlet 900, interior 102 of injector body 101 is also provided with pressurized fuel from common fuel rail 32. In other words, when first and second control valves 40, 41 are in their de-activated positions, the entire interior 102, including first and second control chambers 170, 171, is filled with high pressure fuel from common fuel rail 32. The downward forces exerted on top surfaces 124, 134 by the pressurized fuel in control chambers 170, 171, respectively, along with the biasing force of spring 180, is sufficient to counteract any upward acting forces on hydraulic surfaces 128, 129, 138, 139, and urge first and second needle valve members 120, 130 to their downward, closed positions. Consequently, tips 126, 136 engage first and second seating surfaces 145, 146, respectively, to close first and second nozzle outlets 111, 112.

With renewed reference to FIG. 1, prior to the compression stroke of piston 15, sensors (not shown) disposed in engine 10 may evaluate the operating conditions of engine 10 to, for example, determine if engine 10 is operating in a conventional mode, an HCCI mode, or a transitional mode. Engine 10 may be operating in an HCCI mode during, for example, low load conditions. In such a mode, injector 100 may be operated to perform an HCCI injection event, preferably at or near the beginning of the compression stroke of piston 15. If engine 10 is operating in a conventional mode such as, for example, during high load conditions, injector 100 may be operated to perform a conventional injection event, preferably at or near the end of the compression stroke of piston 15. Finally, if it is determined that engine 10 is operating under a transitional load condition, injector 100 may be operated in a mixed mode configuration. When injector 100 is operating in the mixed mode configuration, both an HCCI injection and the conventional injection event will be performed during the compression stroke of piston 15. That is to say, injector 100 will perform an HCCI injection event when piston 15 is relatively close to the bottom-dead-center position of its compression stroke, and will then perform a conventional injection event when piston 15 is relatively close to the top-dead-center position of the same compression stroke. The remainder of operation of fuel injector 100 of the present disclosure will be described for a transitional load operating condition of engine 10, corresponding to operation of fuel injector 100 in a mixed mode.

Referring to FIGS. 1 and 4, just prior to the beginning of an HCCI injection event, when piston 15 is relatively far from its top-dead-center position, second control valve 41 may be activated, such that pressurized fuel entering inlet 45 from common fuel rail 32 is blocked, and outlet 47 is placed in direct fluid communication with drain outlet 49 and low pressure drain passage 99. As a result of outlet 47 being in fluid communication with second valve inlet 107, second valve inlet 107 is also placed in direct fluid communication with drain passage 99. With valve inlet 107 in direct fluid communication with drain passage 99, the pressurized fuel in control chamber 171 may flow out of control chamber 171, through valve inlet 107, towards low pressure drain passage 99. The flow of fuel out of control chamber 171 may result in a reduction of pressure in control chamber 171 and, consequently, a reduction in the downward forces being applied to top surface 134. The continuous flow of high pressure fuel through rail inlet 108 into control chamber 171 may serve to prevent the complete elimination of fuel pressure within control chamber 171, and may facilitate rapid build-up of pressure within control chamber 171 during the closing of nozzle 104 discussed below. With high pressure fuel still within interior 102, the fluid pressure acting on second lower and upper hydraulic surfaces 138, 139 is now sufficient to overcome the forces of biasing spring 180 and the reduced forces of the remaining fuel pressure, if any, in control chamber 171, and urge second needle valve member 130 towards its open position. The upward movement of needle valve member 130 results in fuel from within interior 102, and bore 142, flowing past seating surface 146 and into cylinder 14 through nozzle 104 in an HCCI injection spray pattern 200, as shown in FIG. 4. When a predetermined amount of fuel has been sprayed out of nozzle 104, second control valve 41 may be de-activated, such that outlet 47 is no longer fluidly connected to drain outlet 49, and the flow of pressurized fuel from inlet 45, through outlet 47, and into second control chamber 171 is restored. The flow of pressurized fuel into second control chamber 171 reapplies downward forces to top surface 134 so that second needle valve member 130, with the aid of biasing spring 180, may be pushed down toward its closed position. As shown in FIG. 3, once second needle valve member 130 is in the closed position, tip 136 of second needle valve member 130 may re-engage the seating surface 146 to cover and close second nozzle openings 112, and cease the flow of fuel into cylinder 14. Furthermore, any fuel sprayed out of interior 102 may be replenished by fuel entering interior 102 through inlet 900.

With the HCCI injection event now complete, piston 15 continues to advance toward its top-dead-center position. Fuel and air within cylinder 14 begin to combine into a homogeneous mixture. In addition, fuel injector 100 prepares for the conventional injection event. Recall that fuel injector 100 will preferably only perform both the HCCI injection event and the conventional injection event during the same piston stroke when engine 10 is operating in a mixed mode, such as during a medium load condition.

To initiate the conventional injection event, as piston 15 approaches its top-dead-center position, first control valve 40 may be activated, such that pressurized fuel entering inlet 44 from common fuel rail 32 is blocked, and outlet 46 is placed in direct fluid communication with drain outlet 48 and low pressure drain passage 99. As a result of outlet 46 being in fluid communication with second valve inlet 105, second valve inlet 105 is also placed in direct fluid communication with drain passage 99. With valve inlet 105 in direct fluid communication with low pressure drain passage 99, the pressurized fuel in control chamber 170 may flow out of control chamber 170, through valve inlet 105, to drain passage 99. The flow of fuel out of control chamber 170 may result in a reduction of pressure in control chamber 170 and, consequently, a reduction in the downward forces being applied to top surface 124 of first needle valve member 120. The continuous flow of high pressure fuel through rail inlet 106 into control chamber 170 may serve to prevent the complete elimination of fuel pressure within control chamber 170, and may facilitate rapid build-up of pressure within control chamber 170 during the closing of nozzle 103 discussed below. With high pressure fuel still within interior 102, the fluid pressure acting on first lower and upper hydraulic surfaces 128, 129 is now sufficient to overcome the forces biasing spring 180 and the reduced forces of fuel pressure in control chamber 170, and urge first needle valve member 120 towards its open position. The upwards movement of needle valve member 120 results in fuel from within interior 102, and bore 141, flowing past seating surface 145 and into cylinder 14 through nozzle 103 in a conventional fuel injection spray pattern 300, as shown in FIG. 5. When a predetermined amount of fuel has been sprayed out of nozzle 103, first control valve 40 may be de-activated, such that outlet 46 is no longer fluidly connected to drain outlet 48, and the flow of pressurized fuel from inlet 44, through outlet 46, and into first control chamber 170 is restored. The flow of pressurized fuel into control chamber 170 reapplies downward forces to top surface 124 so that first needle valve member 120, with the aid of biasing spring 180, may be pushed down toward its closed position. As shown in FIG. 3, once first needle valve member 120 is in the closed position, tip 126 of first needle valve member 120 may re-engage the seating surface 145 to cover and close first nozzle openings 111, and cease the flow of fuel into cylinder 14. Furthermore, any fuel sprayed out of interior 102 may be replenished by fuel entering interior 102 through inlet 900.

Upon conclusion of the conventional injection event, engine 10 prepares for subsequent fuel injection events. Combustion in cylinder 14 drives piston 15 downward for its power stroke. Piston 15 then performs its exhaust and intake strokes in preparation for the next mixed mode injection events. If the operating condition of engine 10 has changed, fuel injector 100 could instead operate in either a pure HCCI mode or a pure conventional mode for the subsequent injection events.

It will be apparent to those skilled in the art that various modifications and variations can be made to the fuel injection system of the present disclosure without departing from the scope of the disclosure. In addition, other embodiments will be apparent to those skilled in the art from consideration of the specification and practice of the system disclosed herein. It is intended that the specification and examples be considered as exemplary only, with a true scope of the disclosure being indicated by the following claims and their equivalents.

What is claimed is:

1. A fuel injector comprising:

an injector body defining a hollow interior configured to receive pressurized fuel, a first nozzle configured for providing a first fuel spray pattern, and a second nozzle configured for providing a second fuel spray pattern different from the first fuel spray pattern, said first and second nozzles adapted to inject fuel supplied from a common source into a combustion space;

a first needle valve member positioned in said hollow interior of said injector body, said first needle valve member corresponding to said first nozzle;

a second needle valve member positioned in said hollow interior of said injector body, said second needle valve member corresponding to said second nozzle, wherein said second needle valve member is spaced from, but adjacent to said first needle valve member;

a first control chamber associated with the first needle valve member; and a second control chamber associated with the second needle valve member, the first control chamber being fluidly separated from the second needle valve member and the second control chamber being fluidly separated from the first needle valve member.

2. The fuel injector of claim 1, wherein said first nozzle includes a plurality of first nozzle openings oriented at a first angle relative to a nozzle centerline of the first nozzle; and said second nozzle includes a plurality of second nozzle openings oriented at a second angle relative to a nozzle centerline of the second nozzle, wherein the first angle is different from the second angle.

3. The fuel injector of claim 1, wherein said injector body further includes at least one inlet configured to provide a direct fluid connection between at least a portion of said hollow interior and said common fuel source.

4. The fuel injector of claim 3, further including at least one spring operably positioned to bias said first and second needle valve members toward contact with said first and second seating surfaces, respectively.

5. The fuel injector of claim 1, wherein said injector body defines the first control chamber and the second control chamber, said first and second control chambers adapted to receive pressurized fuel from the common fuel source.

6. The fuel injector of claim 5, wherein said first needle valve member includes a surface in fluid communication with said first control chamber; and said second needle valve member includes a surface in fluid communication with said second control chamber.

7. The fuel injector of claim 1, wherein said first needle valve member includes a surface exposed to the pressurized fuel within said interior; and said second needle valve member includes a surface exposed to the same pressurized fuel within said interior.

8. A fuel injection system comprising:

a common fuel rail containing pressurized fuel;

at least one control valve fluidly connected to said common fuel rail; and at least one fuel injector fluidly connected to said common fuel rail, and including an injector body having a first nozzle and a second nozzle, said first nozzle configured to produce a first fuel injection spray pattern and said second nozzle configured to produce a second fuel injection spray pattern, wherein the first fuel injection spray pattern is different from the second fuel injection spray pattern, and wherein each fuel injector further includes a first needle valve member and a second needle valve member, said second valve needle member being spaced from, but adjacent to said first needle valve member, the injector body further defining a first control chamber associated with the first needle valve member and a second control chamber associated with the second needle valve member, the first control chamber being fluidly separated from the second needle valve member and the second control chamber being fluidly separated from the first needle valve member.

9. The fuel injection system of claim 8, wherein said at least one fuel injector includes a plurality of fuel injectors.

10. The fuel injection system of claim 8, wherein said first nozzle includes a plurality of openings; and said second nozzle includes a second plurality of openings.

11. The fuel injection system of claim 10, wherein said common fuel rail supplies pressurized fuel to said at least one control valve.

12. The fuel injection system of claim 8, wherein the fuel injector is fluidly connected to said at least one control valve.

13. The fuel injection system of claim 12, wherein said common fuel rail supplies pressurized fuel directly to said fuel injector.

14. The fuel injection system of claim 8, wherein the at least one control valve includes a plurality of control valves, each of said plurality of control valves being independently controlled.

15. A method of injecting fuel, comprising the steps of:

injecting fuel through a first nozzle at least in part by moving a first needle valve member by reducing fuel pressure in a first control chamber within an injector body while maintaining fuel pressure in the remainder of said injector body; and injecting fuel through a second nozzle at least in part by moving a second needle valve member by reducing fuel pressure in a second control chamber within an injector body while maintaining fuel pressure in the remainder of said injector body, wherein said second needle valve member is spaced from, but adjacent to said first needle valve member, the first control chamber being fluidly separated from the second needle valve member and the second control chamber being fluidly separated from the first needle valve member.

16. The method of claim 15, wherein the step of injecting fuel through a first nozzle is performed when an engine piston is closer to a bottom-dead-center position than a top-dead-center-position; and the step of injecting fuel through a second nozzle is performed when an engine piston is closer to a top-dead-center position than a bottom-dead-center position.

17. The method of claim 15, further including the steps of:

ending injection through the first nozzle at least in part by restoring fuel pressure in the first control chamber; and ending injection through the second nozzle at least in part by restoring fuel pressure in the second control chamber.

18. The method of claim 15, wherein the first nozzle is configured to produce a first fuel injection spray pattern; and the second nozzle is configured to produce a second fuel injection spray pattern, wherein the first fuel injection spray pattern is different from the second fuel injection spray pattern.

19. The method of claim 15, wherein reducing fuel pressure in the first control chamber includes fluidly connecting the first control chamber to a low pressure drain; and reducing the fuel pressure in the second control chamber includes fluidly connecting the second control chamber to a low pressure drain.

20. The method of claim 15, wherein said injecting steps are performed in the same engine cycle.

* * * * *